United States Patent [19]

Kipp et al.

[11] 4,109,848

[45] Aug. 29, 1978

[54] TUBULAR CARTON

[75] Inventors: Michael A. Kipp, Phoenixville, Pa.; Arne H. Brauner, Greensboro, N.C.

[73] Assignee: Container Corporation of America, Chicago, Ill.

[21] Appl. No.: 765,241

[22] Filed: Feb. 3, 1977

Related U.S. Application Data

[63] Continuation-in-part of Ser. No. 654,889, Feb. 3, 1976, abandoned.

[51] Int. Cl.[2] ..... B65D 3/04

[52] U.S. Cl. ..... 229/21; 229/41 B

[58] Field of Search ..... 229/4.5, 21, 41 C, 41 B, 229/41 D

[56] References Cited

U.S. PATENT DOCUMENTS

| | | | |
|---|---|---|---|
| 1,201,823 | 10/1916 | Holbke et al. | 229/21 |
| 2,226,178 | 12/1940 | Page | 229/41 B X |
| 3,411,692 | 11/1968 | Mathews | 229/21 |
| 3,695,167 | 10/1972 | Schmidt et al. | 229/41 B X |
| 3,912,331 | 10/1975 | Turner | 229/41 B |
| 3,918,629 | 11/1975 | Forbes et al. | 229/21 |

*Primary Examiner*—Stephen P. Garbe
*Attorney, Agent, or Firm*—Carpenter & Ostis

[57] ABSTRACT

A tubular carton is formed from a blank of paperboard and has a side wall interconnected to a bottom wall by intermediate panels. The intermediate panels are joined to the bottom wall along convex/concave score lines.

1 Claim, 13 Drawing Figures

TUBULAR CARTON

This application is a continuation-in-part of our copending application, Ser. No. 654,889, filed Feb. 3, 1976 now abandoned.

BACKGROUND OF THE INVENTION

1. Field of the Invention

This invention relates to a carton formed from paperboard or the like and, more particulary, to a carton having substantially cylindrical or substantially frustoconical configuration.

2. The Prior Art

Heretofore, paperboard cartons having round, oval or similarly shaped bottom walls were formed by folding a paperboard tube having two side wall forming body panels. Each panel had a disc attached to a small portion of its lower edge along a common fold line.

The length of the fold line was minimized so as to have the erected carton as cylindrical as possible (the straight fold line obviously caused a distortion in the desired circular shape of the base). By minimizing the length of the score line, the strength and interegrity of the bottom was sacrificed somewhat. This was true of a conventional flush bottom or recessed bottom round container.

SUMMARY OF THE INVENTION

The carton has side wall forming panels connected to the bottom wall by intermediate panels. The intermediate panels are foldably joined to the bottom wall along convex/concave score lines. By using the convex/concave score lines, the length of the score line is significantly increased thus increasing the strength of the bottom structure of the carton. The convex/concave, or arcuate, score line makes it possible to have a completely round bottom wall, as distinguished from a cylindrical carton with flat facets. Further, the present concept provides a possibility of constructing a liquid tight bottom by carrying the opposed arcuate score lines to a meeting point.

The basic concept is readily adaptable to flush bottom wall or recessed bottom wall variations, and the arcuate line can be easily changed to an eliptical curve or rounded corner polygonal shapes without sacrificing structural integrity.

DRAWINGS

Figure 1:
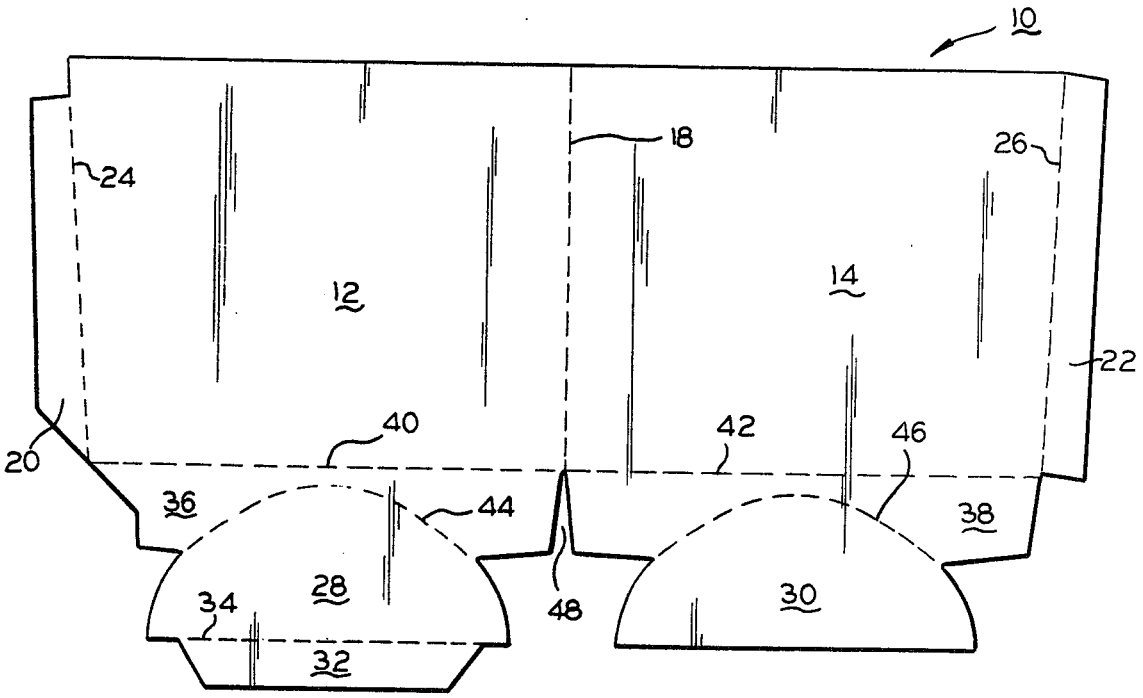
FIG. 1 is a plan view of a blan used to form a carton of the first embodiment of the present invention.
Figure 2:
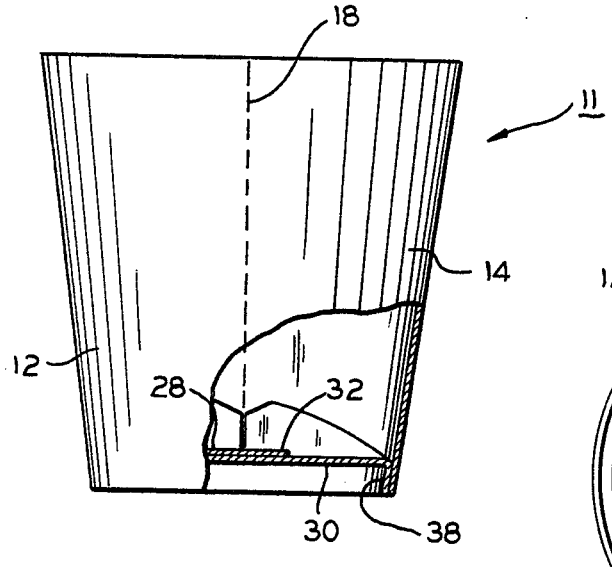
FIG. 2 is a side elevational view of a carton formed from the blank shown in FIG. 1 with a portion of the side wall cut away for clarity.
Figure 3:
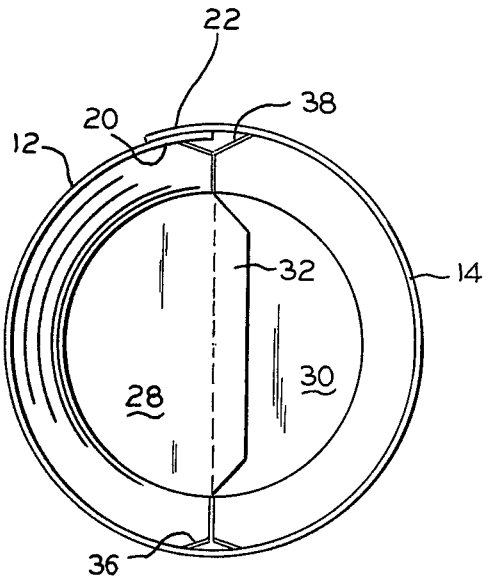
FIG. 3 is a top plan view of the carton shown in FIG. 2.

Referring now to the drawings, more specifically to FIGS. 1 through 3, there is shown a first embodiment of the present invention comprising a blank, generally designated 10, and a carton, generally designated 11, formed from the blank 10.

The blank 10 has a pair of body panels 12 and 14 foldably connected to each other along a score line 18. The body panels form a side wall of the carton, as later described. The outer vertical side edges of the body panels 12 and 14 are provided with attaching panels 20 and 22, respectively. The panel 20 is foldably attached to the body panel 12 along a fold line 24, while the panel 22 is foldably attached to the body panel 14 along a fold line 26. Since it is desired to form a tubular, substantially cylindrical carton having tapered side wall, fold lines 24 and 26 converge slightly toward one another in the downward direction between top and bottom edges of the body panels, as viewed in FIG. 1. In view of the taper in the side wall, fold lines 24 and 26 are not parrallel to the score line 18 mentioned above.

As best seen in FIG. 1, there are two bottom wall forming panel portions 28 and 30. The panel portion 28 has an attaching flap 32 foldably joined to the outer edge thereof along a fold line 34.

The panel portion 28 is connected to the side wall forming body panel 12 by an intermediate panel 36, whereas the panel portion 30 is connected to the body panel 14 by an intermediate panel 38.

The intermediate panels 36 and 38 are foldably joined to their respective body panels 12 and 14 along substantilally straight fold lines 40 and 42, respectively. The intermediate panels 36 and 38 are foldably attached to the bottom wall forming panel portions 28 and 30 by convex/concave score lines 44 and 46, respectively. The interior tapered edges of the intermediate panels 36 and 38 are spaced from each other as indicated at 48.

In forming the caron 11 from the blank 10, glue panels 20 and 22 are secured to each other in an overlapped relation forming a tapered tubular structure, as best seen in FIG. 2. The glue panel could overlap a marginal area of the body panel and could be secured thereto. Likewise, glue panels could be eliminated and the marginal areas of the body panels could be secured to one another in an overlapped relation.

The intermediate panels 36 and 38 are folded in such a manner as to provide a recessed and curved bottom wall formed from overlapped bottom panel portions 28 and 30 which are secured to one another. The carton so constructed can be collapsed into flat position and reerected again by inward pressure on the side wall of the carton from two opposite sides.

Figure 4:
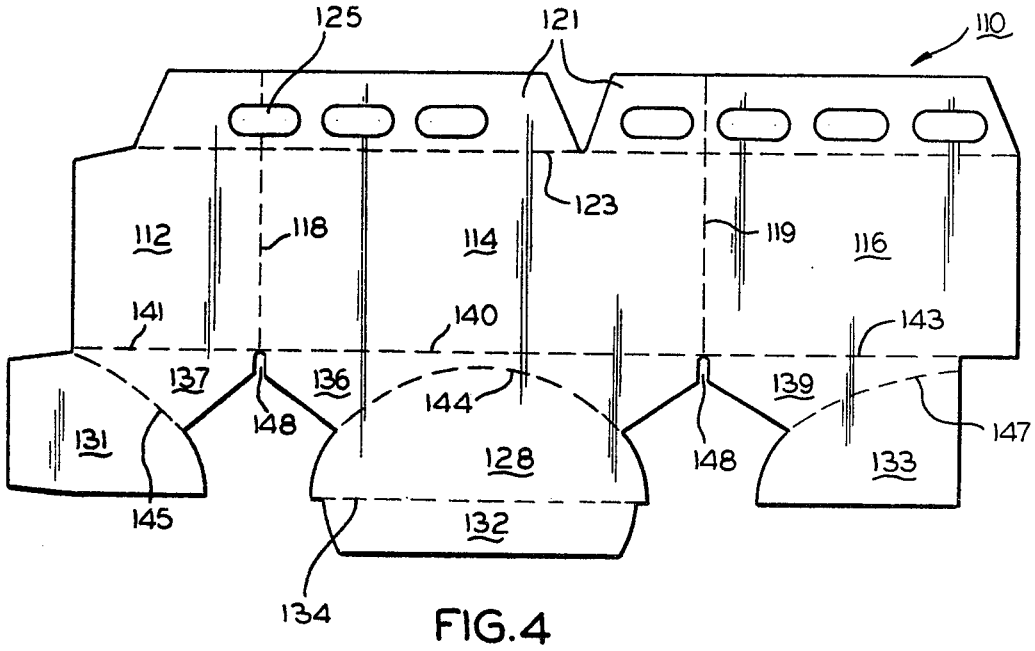
FIG. 4 is a plan view of a blank used to form a carton of the second embodiment of this invention.
Figure 5:
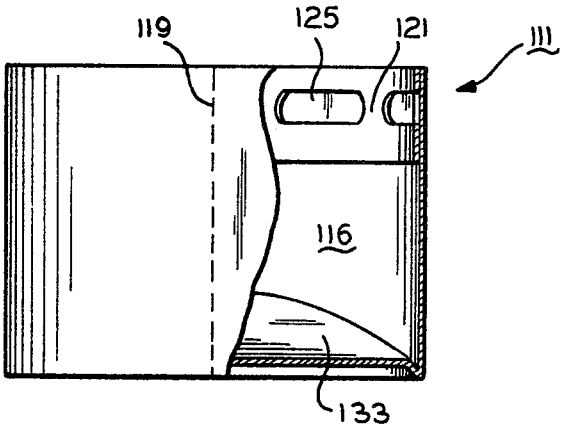
FIG. 5 is a side elevational view of a carton formed from the blank shown in FIG. 4 with a portion of the side wall cut away.
Figure 6:
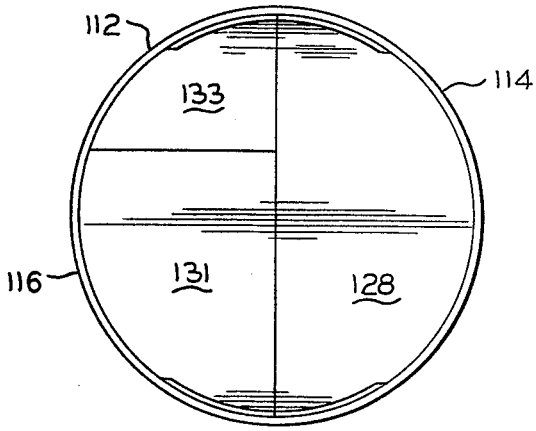
FIG. 6 is a top plan view of the carton shown in FIG. 5.

Referring now to FIGS. 4 thru 6, there is shown a second embodiment of the present invention. Like elements have been designated with the same numerals used to designate the elements in the description of the first embodiment except that 100 has been added to each numeral to describe the elements of the second embodiment.

The second embodiment comprises a blank, generally designated 110 and a carton, generally designated 111 formed from said blank. The blank 110 has three body panels 112, 114 and 116 foldably connected by score lines 118 and 119. In this exemplary embodiment, the three body panels are of different sizes. The areas along remote side edges of the panels 112 and 116 are secured to one another in overlapped fashion when the carton is constructed and thus perform a function similar to the one performed by the glue panels 20 and 22 of the first embodiment. The blank shown in FIG. 4 has a top edge flap 21 foldably connected to the body panels along fold line 123. As best seen in FIG. 5 the top edge flap is folded inwardly into the carton and is formed with a plurality of apertures 125 adapted to receive and securely hold a cover (not shown).

There are three bottom wall forming panel portions of differing sizes and shapes. A panel portion 128 has an attaching flap 132 foldably joined thereto along a fold line 134. Flap portions 131 and 133, when joined to each other, generally represent a structure similar to the panel portion 30 illustrated in FIG. 1.

There are three intermediate panels in this embodiment. Intermediate panel 136 joines the panel portion 128 to the body panel 114 and has a substantially straight fold line 140 joining it to the body panel 114 and a convex/concave fold line 114 joining it to the panel portion 128. The remaining intermediate panels 137 and 139 are attached to the respective body panels 112 and 116 along straight fold lines 141 and 143, respectively. A curved fold line 145 joins panel portion 131 to the intermediate panel 137, while a curved fold line 147 performs a similar function between the panel portion 133 and the intermediate panel 139. The inner edges of intermediate panels are spaced from each other as indicated at 148.

The carton is constructed in a manner similar to that used in constructing carton 11 of the first embodiment. In the present embodiment, the body panels 112 and 116 have their remote side edge area secured in an overlapped relation. A recessed and curved or concavely depressed bottom wall is formed from three panel portions, namely 128, 131 and 133. As mentioned before, the carton of this embodiment is provided with an inwardly folded top edge flap 121 and presents a straight sided rather than tapered configuration with a substantially circular cross section.

Figure 7:
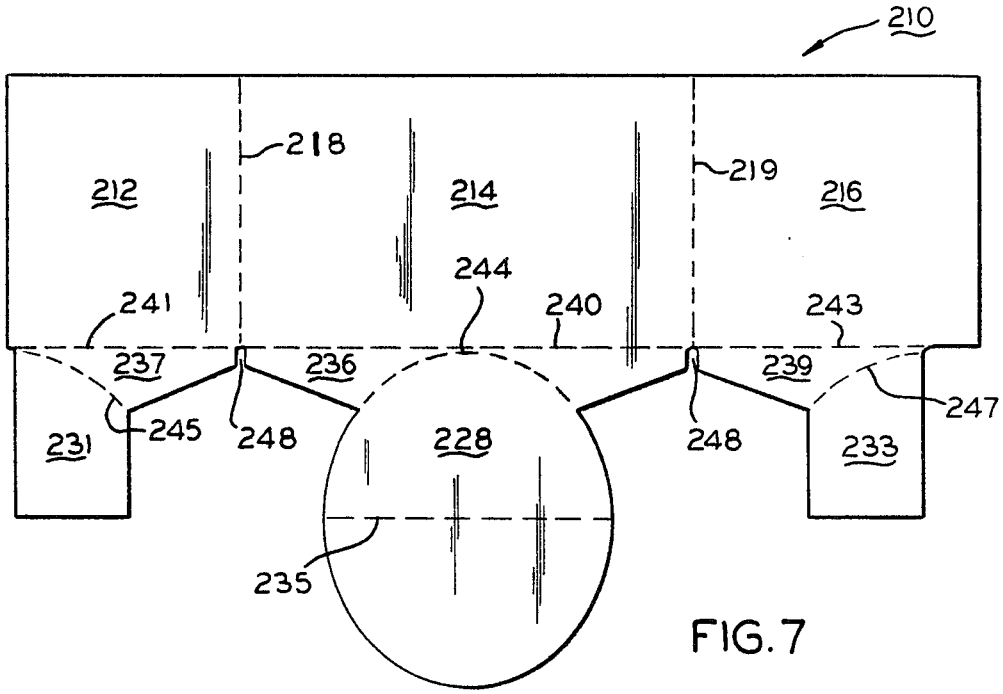
FIG. 7 is a plan view of a blank used to form a carton of the third embodiment of this invention.
Figure 8:
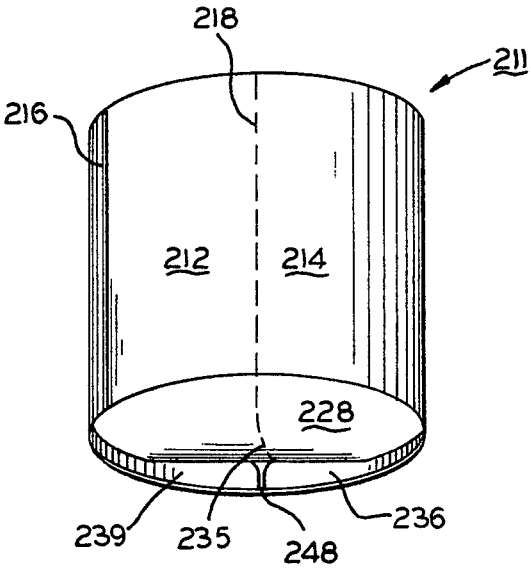
FIG. 8 is a perspective view showing the bottom and side walls, of the carton formed from the blank of FIG. 7.
Figure 9:
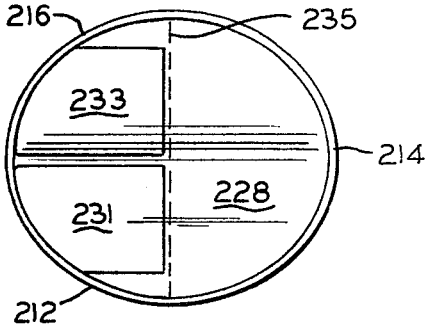
FIG. 9 is a top plan view of the carton of FIG. 8.
Figure 10:
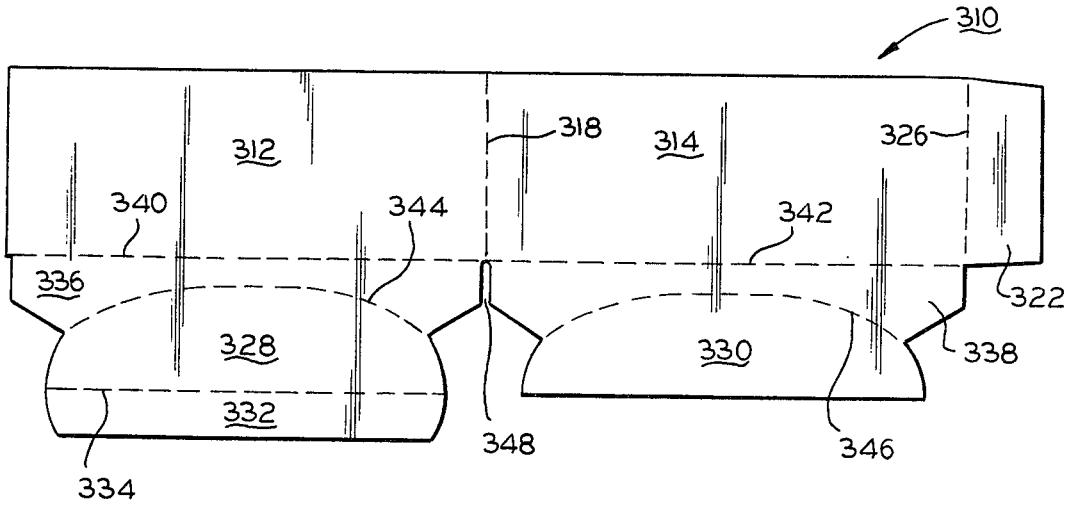
FIG. 10 is a plan view of a blank used to form a carton of the fourth embodiment of the present invention.
Figure 11:
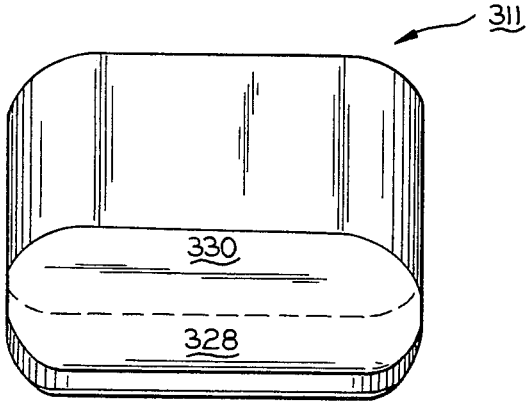
FIG. 11 is a perspective view, showing the bottom and side walls, of the carton formed from the blank illustrated in FIG. 10.
Figure 13:
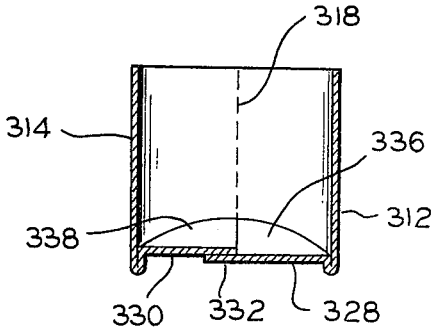
FIG. 13 is a sectional view of the carton taken along the lines 13-13 of FIG. 12.
Figure 12:
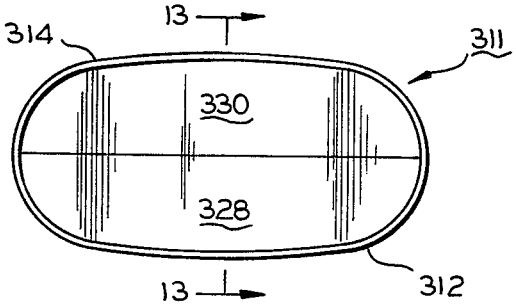
FIG. 12 is a top plan view of the carton shown in FIG. 11.

The third embodiment of the present invention is illustrated in FIGS. 7 through 9. Here, again, like elements have been designated with the same numerals used heretofore except that 200 has been added to each numeral.

A blank 210 of this embodiment is generally similar to the blank 110 of FIG. 4 and is used to form a carton 211 having straight, rather than tapered, side wall. There are three body panels of varying size identified by numerals 212, 214 and 216. Score lines 218 and 219 foldably connect the adjacent body panels to each other.

The bottom wall of the carton 211 is formed from a panel portion 228 of generally eliptical configuration which is divided into two segments by a fold line 235. The panel portions 231 and 233 overlap the portion 228 and are secured thereto by any suitable means well known in the art. As best seen in FIG. 8, the bottom wall is not flat but has a curved configuration.

An intermediate panel 237 interconnects the panel portion 231 with the body panel 212 so that the panel portion 231 can be folded on the curved score line 245 while the intermidiate panel 237 can be folded against the body panel 212 along a substantially straight score line 241.

Similarly, an intermediate panel 236 is foldably joined to the body panel 214 along a substantially straight score line 240 and to the bottom wall forming portion 228 along a convex/concave, or curved, score line 244. An intermediate panel 239 is foldably joined to the body panel 216 along a line 243 while being foldably attached to the panel portion 233 along a curved score line 247. The intermediate panels are spaced from each other as shown at 248.

In forming the tubular configuration the marginal areas along the remote edges of the body panels 212 and 216 are secured in an overlapped relation.

Once the carton is formed, it can be collapsed by folding its bottom wall along the line 235 and its side wall along the lines 218 and 219. As described in connection with prior embodiments, the carton can be brought out of collapsed position by pressure applied against opposite edges of the bottom wall at the ends of the line 235.

The fourth embodiment of the present invention is shown in FIGS. 10 through 13 with like elements designated with the same numerals as before except that 300 has been added to each numerals.

A blank 310 is used to form a tubular carton 311 of substantially oval cross-section.

A side wall is formed from body panels 312 and 314 foldably connected along a score line 318. A panel 322 which is an extension of panel 314 is secured to the outer surface of panel 312.

The bottom wall is concavely depressed, or dished-out and is formed from two panel portions 328 and 330 in an overlapped manner and secured by an attaching flap 332 foldably joined to the portion 328 by a line 334.

Generally straight fold lines 340 and 342 secure an intermediate panel 336 to the body panel 312 and an intermediate panel 338 to the body panel 314, respectively.

Convex/concave lines 344 and 346 foldably attach the intermediate panels 336 and 338 to the panel portions 328 and 330, respectively.

The inner edges of the intermediate panels 336 and 338 are spaced from each other as indicated at 348.

The carton 311 is collapsible along lines 318, 326 and 334 and can be re-erected as described heretofore in regard to other embodiments of this invention.

We claim:

1. A tubular carton formed from a cut and scored blank of paperboard, or the like, comprising:

(a) a side wall formed from a plurality of body panels arranged in a side-by-side relation, with adjoining panels being foldably connected to each other along a score line;

(b) a recessed, concavely depressed bottom wall formed from at least two ovelapping bottom panel portions secured to each other;

(c) each of said body panels being connected to a corresponding one of said bottom panel portions by an intermediate panel;

(d) said intermediate panel and said body panel being substantially of equal length and being foldably connected along the entire length of their adjacent edges;

(e) said intermediate panel being foldably connected to a bottom panel portion along a concave/convex fold line;

(f) said side wall having remote side edges secured to each other in an overlapped relation to form a tubular structure collapsible into a substantially flat configuration.

* * * * *